United States Patent [19]

Dammann

[11] Patent Number: 4,619,596

[45] Date of Patent: Oct. 28, 1986

[54] SCREW TYPE COMPRESSOR

[75] Inventor: Karl-Heinz Dammann, Bielefeld, Fed. Rep. of Germany

[73] Assignee: Technika Beteiligungsgesellschaft mbH, Bielefeld, Fed. Rep. of Germany

[21] Appl. No.: 433,700

[22] Filed: Oct. 12, 1982

[30] Foreign Application Priority Data

Oct. 9, 1981 [DE] Fed. Rep. of Germany ..... 3140108

[51] Int. Cl.[4] ..... F04C 18/00

[52] U.S. Cl. ..... 418/201; 418/150; 74/458

[58] Field of Search ..... 418/150, 201–202, 418/203, 220, 197; 74/458

[56] References Cited

U.S. PATENT DOCUMENTS 2,486,770 11/1949 Whitfield ..... 418/201
3,138,110 6/1964 Whitfield ..... 418/201
3,423,017 1/1969 Schibbye ..... 418/201
3,938,915 2/1976 Olofsson ..... 418/201

FOREIGN PATENT DOCUMENTS 254986 7/1926 United Kingdom ..... 418/201

OTHER PUBLICATIONS

Reutter, Fritz, *Descriptive Geometry,* Fifth Edition, Verlag G. Braun Press, Karlsruhe, pp. 158–173.

*Primary Examiner*—Carlton R. Croyle
*Assistant Examiner*—Jane E. Obee
*Attorney, Agent, or Firm*—Burns, Doane, Swecker & Mathis

[57] ABSTRACT

A parallel and outer axial rotating piston compressor comprises at least one driven helical main rotor and one auxiliary rotor meshing therewith. The main rotor includes tooth surfaces comprising layered circular helicoids defined by the helical generation of a circle whose plane is perpendicular to the rotor axis.

3 Claims, 7 Drawing Figures

SCREW TYPE COMPRESSOR

RELATED APPLICATION

Attention is directed to my concurrently filed application Ser. No. 06/433,699, entitled "Rotating Piston Compressor".

BACKGROUND AND OBJECTS OF THE INVENTION

The invention relates to a parallel and outer axial rotating piston compressor with at least one helical main rotor and correspondingly at least one auxiliary rotor meshing therewith.

Such a rotating piston compressor is known, e.g. from DE-OS No. 2 505 113, the disclosure of which is incorporated herein by reference. The Offenlegungsschrift deals in particular with the shape of the tooth surfaces of the auxiliary rotor, in order to keep the blow-hole of the compressor toothing as small as possible. This is achieved in that the contact line along which the flanks of a tooth each of main and auxiliary rotors, respectively, of a tooth pair in engagement adjoin, does not reach to the housing edge which is produced by the section of the two housing bores (see also Rinder, Springer Verlag, Vienna, N.Y., 1979, p. 72 ff, which is also incorporated herein by reference).

Similarly, U.S. Pat. No. 2,622,787 deals with the reduction of leakage produced due to the blow-hole. The disclosure of this patent is also incorporated herein by reference.

These and other known rotating piston compressors have symmetrical and non-symmetrical tooth profiles composed of differently dimensioned curve segments which are mathematically often not uniformly definable. In general, the teeth are deeply cut in, see also Rinder, Screw Compressors, p. 28, FIG. 11, where the construction and build-up of a non-symmetrical rotor is described in more detail.

The rotors of screw compressors must be produced with the greatest precision possible to keep leakage as small as possible; thus, expensive and costly tools and tool machines are necessary. Due to the complicated shape of the individual profiles, special cutters are required and the production of a rotor demands several work steps (e.g., pre-cutting with so-called roughing cutters, and then finishing with finishing or fine cutters). A cutter set for a rotor pair can be expensive, the cost depending on the diameter. The cost for final inspection is added to this.

Rotating piston compressors are available on the market which have different output volumes to satisfy each desired requirement. Accordingly, the manufacturers offer compressor series wherein the distance between the steps is chosen relatively large because of the expensive production, so that not too many expensive tools must be produced and kept in storage. Consequently, the individual rotating piston compressor types of a series are not operated in their optimal region or near the optimal region but over a larger region. In FIG. 1, the specific rate of power input ($kW/m^3/min$) is plotted versus the output volume ($m^3/min$). On the abscissa, the circumferential speed of a rotor or its rotational speed could be plotted; this would change nothing of the qualitative statement. The optimal operational point lies at point A on the drawn curve, as can be seen in FIG. 1. The rotating piston compressors on the market run in the region BAC that is not exclusively in or near the optimal region, which would lie approximately at B'AC', in order to let the output volume stream of a type link-up with the next larger type without a gap. The expansion of the output amount region of each type must be achieved by variation of the rotational speed with transmission gears (belt or toothed-wheel gearing, or by regulation of the rotational speed of the drive motor). If one wanted to operate the rotating piston compression in the region B'AC', the output volume stage would have to be decreased. But to achieve this, as mentioned above, a larger number of rotating piston compressor types would be required and a larger number of expensive tools.

It is the object of the invention to create a rotating piston compressor of the initially described type which is easy to produce and which requires only relatively inexpensive tools for manufacturing the profiles. Furthermore, the dimensional control should be carried out precisely, economically and simply.

SUMMARY OF THE INVENTION

This object is achieved according to the invention in that the tooth flanks of the main rotor comprise layered circular helicoids produced by the helical generation of a circle whose plane is perpendicular to the rotor axis.

A further advantageous feature of the invention involves the fact that the tooth flanks of the auxiliary rotor are defined by the travel path of a point lying on an addendum line (main rotor head point) during the relative rolling motion of the main rotor and the auxiliary rotor.

Preferably, the main rotor has at least three teeth.

In the chosen profile according to the invention, the tooth flanks of the main rotor are not composed of curve segments but rather, because of the producing circles, are formed by a steady smooth, analytically definable curve shape from head point to head point, in this case, arcs of circles. The tooth flanks comprise layered circular screw planes produced by circles (compare Wunderlich, Descriptive geometry, volume 2 of Series B.I., Hochschultaschenbucher, Volume 133, 1967, pg. 188 ff). The flanks of the teeth are produced by a hobbing operation with a profile cutter. The profile cutter has a curved mantile line which can be shaped according to the front face cut form.

Due to the choice of the profile of the main rotor, the tooth flanks of the auxiliary rotor are formed by a wheel curve which can be produced by a profile cutter with a shape similar to a circular arc.

The advantages of the embodiment according to the invention therefore consist especially therein, that the production of the main rotor as well as the auxiliary rotor is simplified and therefore overall more economical. The dimensional control at final inspection is simplified because the curves of the profiles of the main and auxiliary rotors are much easier to describe than known profiles. Much less machining work is also required.

Due to smaller costs and simple geometry, a large variety of types is moreover possible, so that a rotating piston compressor series can be offered which has a finer graduation compared to known compressor series. An optimization of the efficiency of the individual rotating piston compressor of the series is possible by choosing optimal circumferential speeds with elimination of gears (gear wheels and pinions or belts adapted to the electrical standard rotational speed of, for example, a drive designed for an electromotor). The individual rotating piston compressor can be operated in direct drive mode in the B'AC' region (FIG. 1), so that the optimal work region can be exploited.

Due to the simplification of the profile, the geometry of the finished rotor is also easier to measure and final inspection can be more economical, as mentioned above. The individual rotating piston compressor of such a series can be driven directly as mentioned above, without insertion of an intermediate set of gears, so that an improvement in efficiency can be hereby achieved.

A further advantage of the embodiment according to the invention consists in the following: in known rotors, the tooth depth, i.e., the groove depth between the neighboring head lines is large. This results in a ratio of core diameter to outer diameter that is also large. In known rotors, this value lies between 0.4 and 0.5. In the rotor according to the invention defined by the features of the characterizing clause of claim 1, the ratio of core diameter to outer diameter is approximately 0.95. The expected bending-through of the main rotor according to the invention compared to known main rotors is practically 0. Therefore, the tolerances can be held very small and moreover the main rotor is very robust. Due to these tolerances the efficiency can be additionally improved.

THE DRAWING

The invention as well as advantageous embodiments and improvements of the invention shall be described and explained more closely with the aid of the drawing in which an exemplary embodiment of the invention is shown:

DETAILED DESCRIPTION OF A PREFERRED EMBODIMENT OF THE INVENTION

Figure 1:
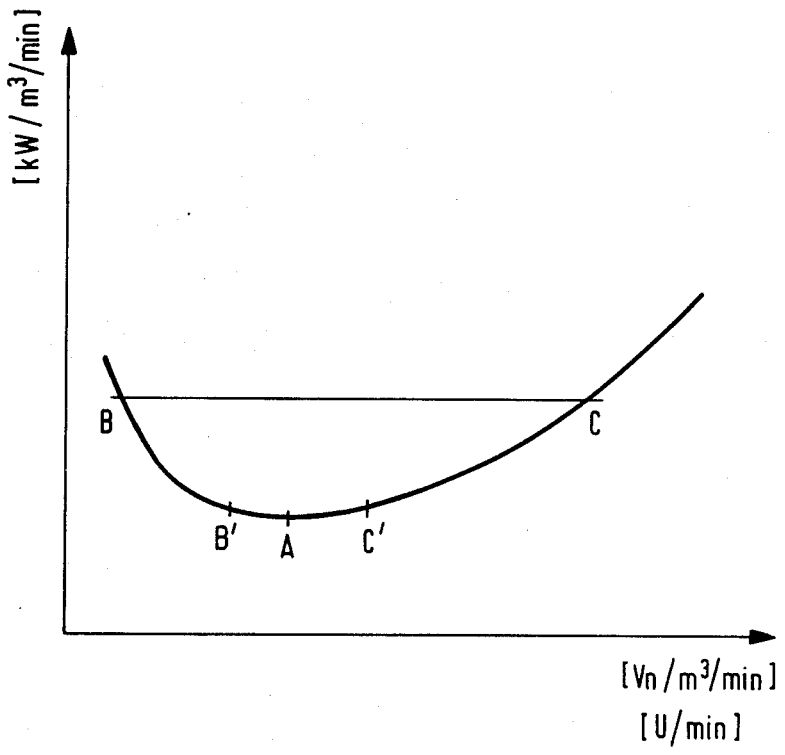
FIG. 1 shows a graph in which the specific energy need in $kW/m^3/min$ is plotted versus an output amount in $m^3/min$.
Figure 2:
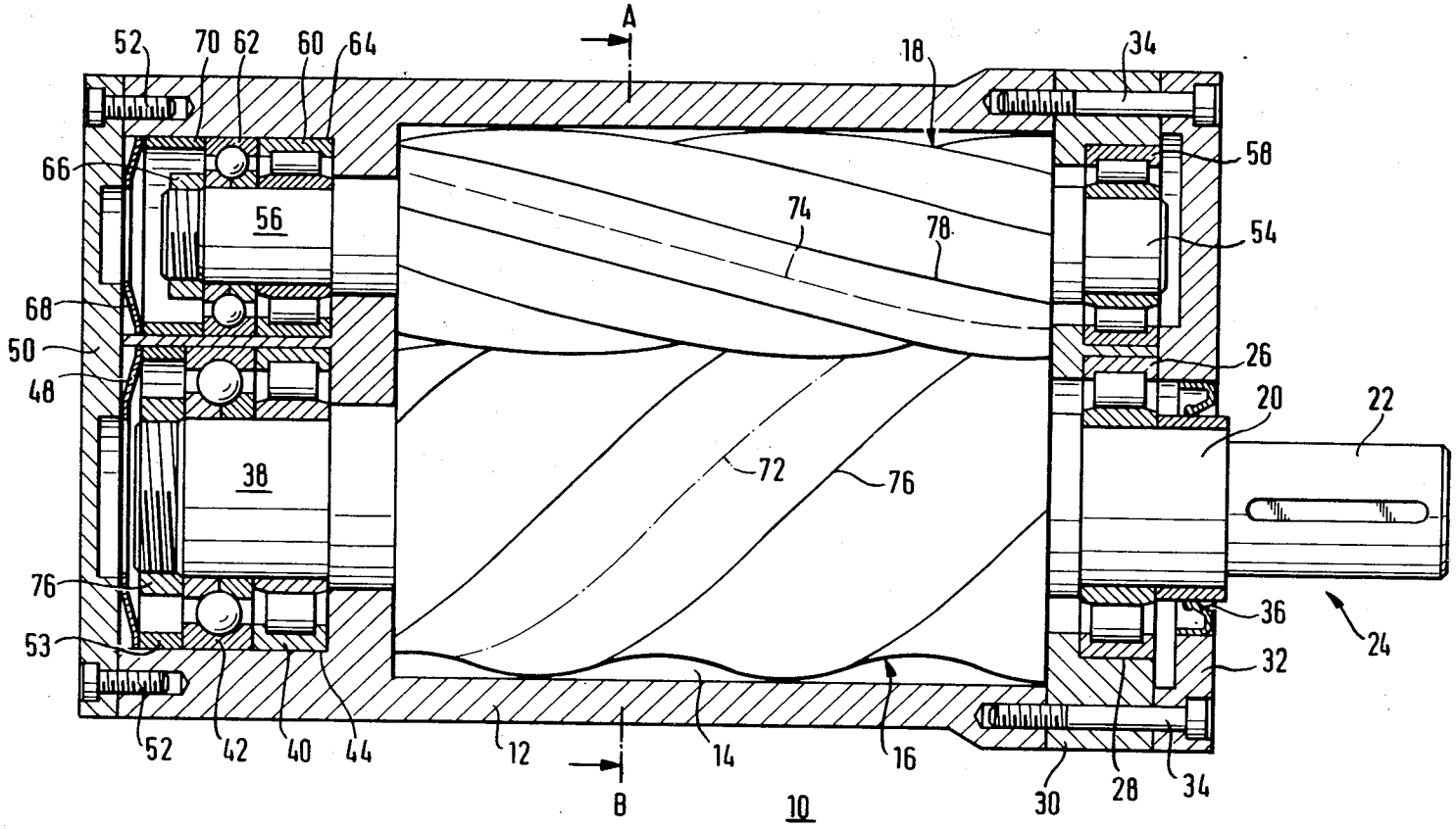
FIG. 2 is a longitudinal section of the rotating piston compressor according to the invention.

Attention is called first to FIG. 2. The rotating piston compressor 10 has a compression chamber 14 in a housing 12 wherein a main rotor 16 and an auxiliary rotor 18 meshing therewith are arranged. The main rotor 16 has an extension 24 at one end which is divided into two parts 20 and 22 with different diameters, of which one part 20 with the larger diameter serves for support within roller bearings 26, and the other part 22 with a smaller diameter serves for connection of a drive (not shown). The bearing 26 is located in a bearing opening 28 in a bearing disk 30 which is firmly connected with the housing 12 with a closure lid 32 by a screw connection 34. A sealing ring 36 is provided for sealing of bearing 26 to the outside.

At the opposite end, the main rotor 16 has another bearing pin 38 which is supported in a roller bearing 40 and a ball bearing 52 in a first bearing opening 44 of a housing 12. The attachment of bearings 40 and 42 is achieved on the inside by a nut 46 screwed onto bearing pins 38 and on the outside by a pressure spring 48 which is supported by a second closure lid 50 which is firmly connected with the housing by screw bolts 52 with insertion of a fixing jacket 53.

In a similar fashion, the auxiliary rotor 18 has bearing pins 54 and 56. The bearing pin 54 is supported in a roller bearing 58 in the bearing disk 30. The bearing pin 56 is supported in a roller bearing 60 and a ball bearing 62 in a second bearing opening 64 in housing 12. The attachment or axial fixation of the bearings 60 and 62, is achieved at the inner diameter or inner race (ring) of the bearings by a nut 66 screwed onto the bearing pin 56. Axial fixation at the bearing outer ring is achieved by a pressure spring 68, which presses a fixing jacket 70 against the outer race.

The throat line of the main rotor i.e., a line on the tooth defined by the shortest distance from the longitudinal axis of the rotor and located midway between adjacent head points is represented by the dash-dot line 72. The dash-dot line of the auxiliary rotor is given the reference numeral 74. The reference numerals 76 and 78 refer to the head lines of the main and auxiliary rotors, respectively, i.e., the lines on the teeth defined by the longest distances from the longitudinal axis of the rotor.

Figure 3:
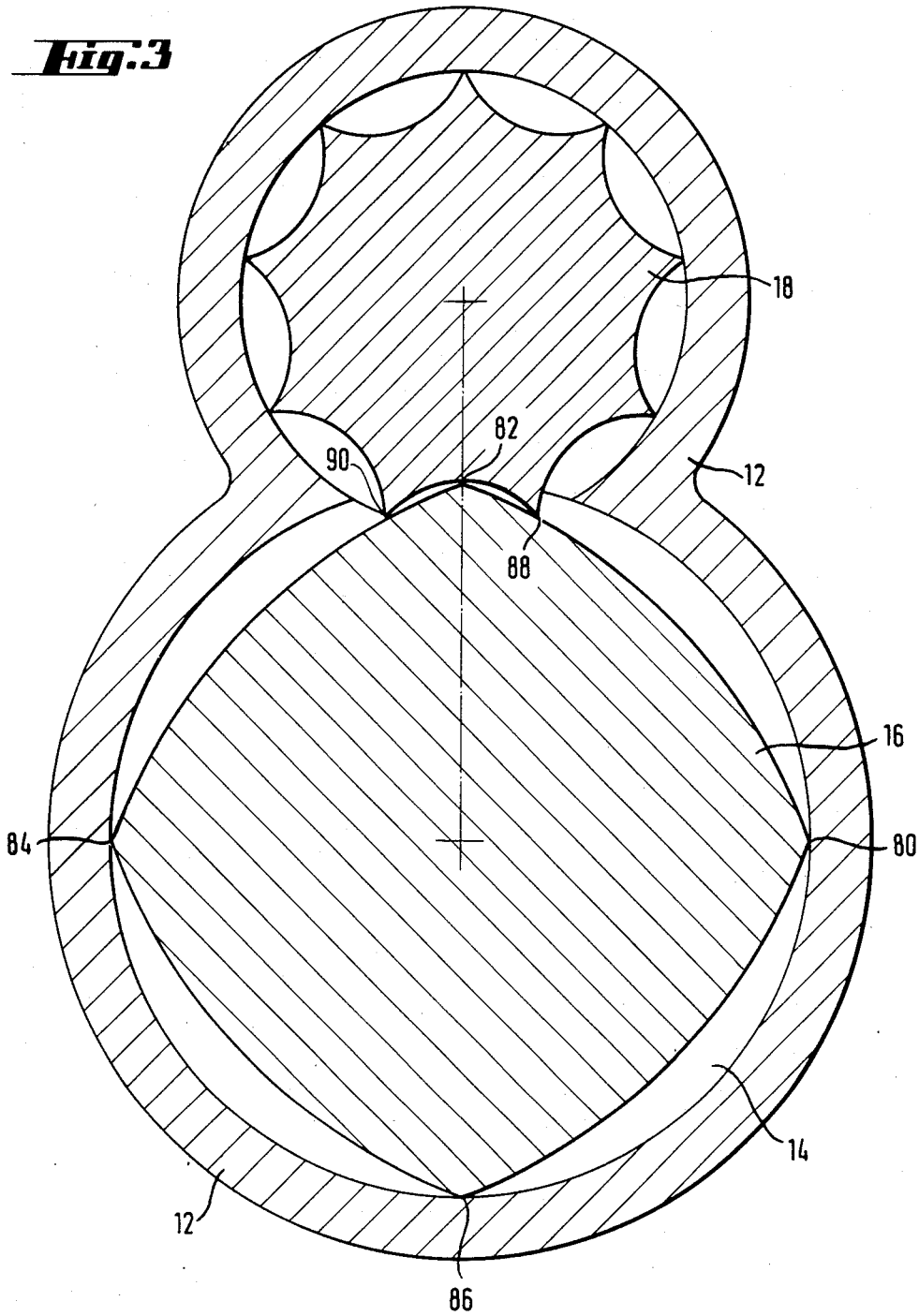
FIG. 3 is a sectional view along line III—III of FIG. 1.

In FIG. 3, a cross-section along line A-B of FIG. 2 is shown. The main rotor 16 has a total of four teeth, the head points on the head lines 76, i.e., the points located farthest from the longitudinal axis the rotor is viewed in cross section, of which are indicated in the sectional view according to FIG. 3 by reference numerals 80, 82, 84 and 86. The teeth of the main rotor are formed by layered circular screw surfaces defined by the screwing, i.e., helical, motion of a circle whose plane is perpendicular to the axis of the helix, i.e., a layered circular helicoid.

The production of the main rotor is achieved by a roller cutting process with a profile cutter.

The auxiliary rotor 18 has nine teeth (which are not given individual reference numerals), and as is shown in FIGS. 4 to 7, the tooth flanks between the teeth are defined by the travel path of head points 80 to 84 of main rotor 16. Actually, the auxiliary rotor teeth flanks with sharp pointed auxiliary rotor teeth are not circular, but rather comprise helical epitrochoids which can, however, be substituted approximately during production by their circles of curvature, that is, by circular arcs.

Figure 4:
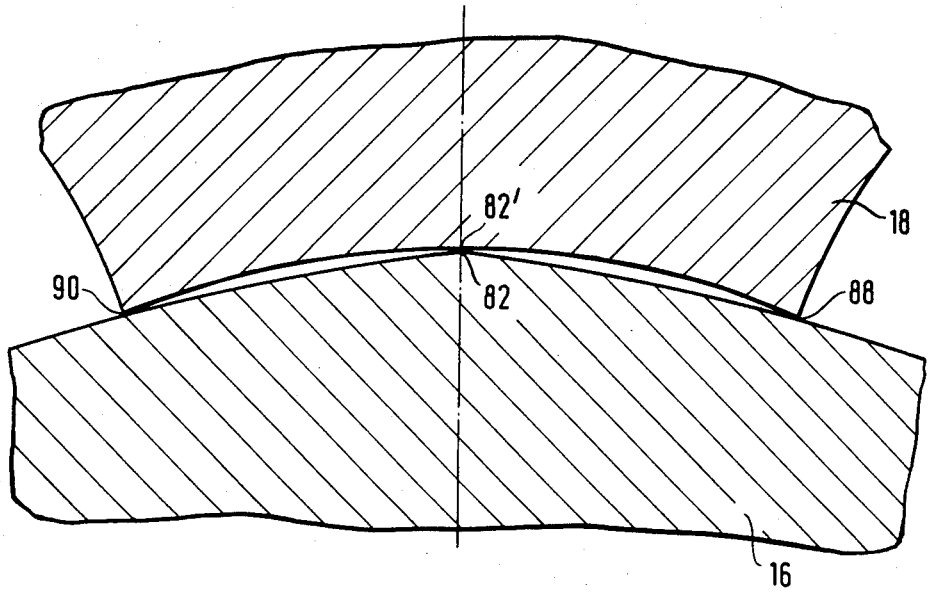
FIGS. 4 to 7 are representations of the arrangement of main and auxiliary rotors in different positions relative to one another.
Figure 5:
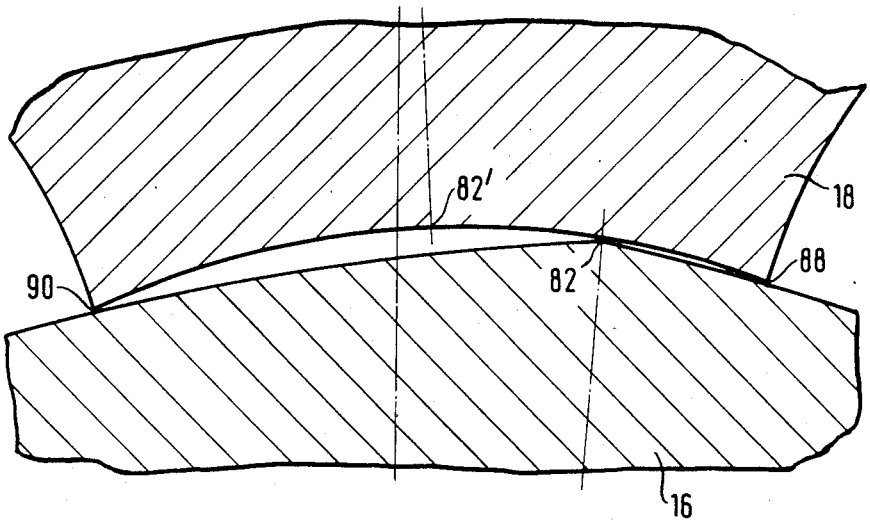
Figure 6:
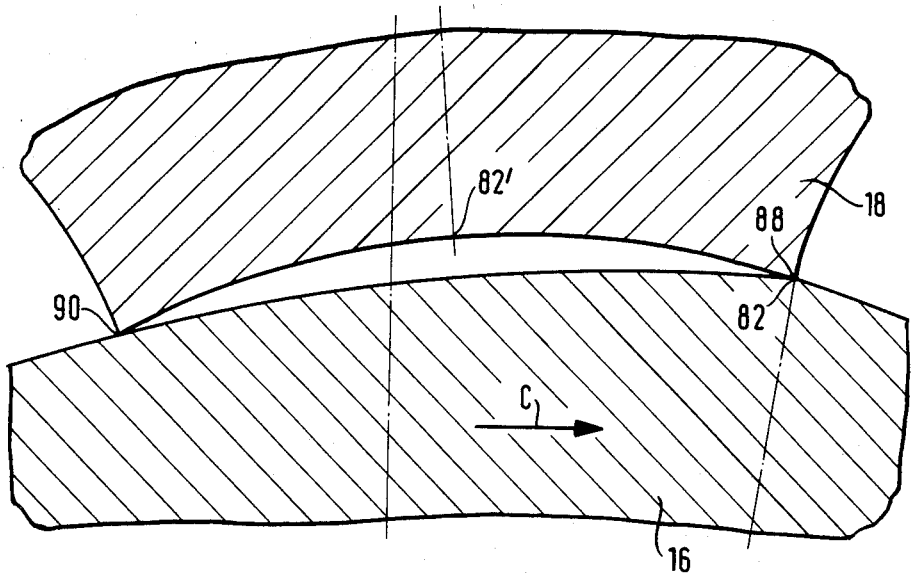

FIG. 4 shows a first position of the main and auxiliary rotors relative to one another, wherein the head point 82 of the main rotor 16 in the position shown, i.e., the head point center line, lies exactly on the connecting line V—V of the central axes of the rotors. The head point 82 is flush with the throat point or minimal radius point 82'of the auxiliary rotor 18, which also lies on the connecting line V—V between the center axes of both rotors. In this case, the head point center line and the throat point center line fall together. The head points 88 and 90 of the auxiliary rotor 18 lie exactly on the tooth flank of a tooth which has the head point 82. If the main rotor is turned in the direction of arrow C, the head point center line is moved clockwise relative to the auxiliary rotor (downwards in FIG. 5) and the head point 82 comes to rest on the tooth flank of the auxiliary rotor, whereby it can be seen that the tooth flank of the auxiliary rotor is determined by the path of the head point 82. Head point 90 of the auxiliary rotor 18 is still resting on the other tooth flank. The throat point center line 82' of auxiliary rotor 18 has moved counterclockwise (about its own axis) by a lesser amount corresponding to the differential rate of rotational speed between main and auxiliary rotors. Both the throat point center line 82' and the head point 82 are not spaced from the connecting line V—V of the center points of the two rotors.

Figure 7:
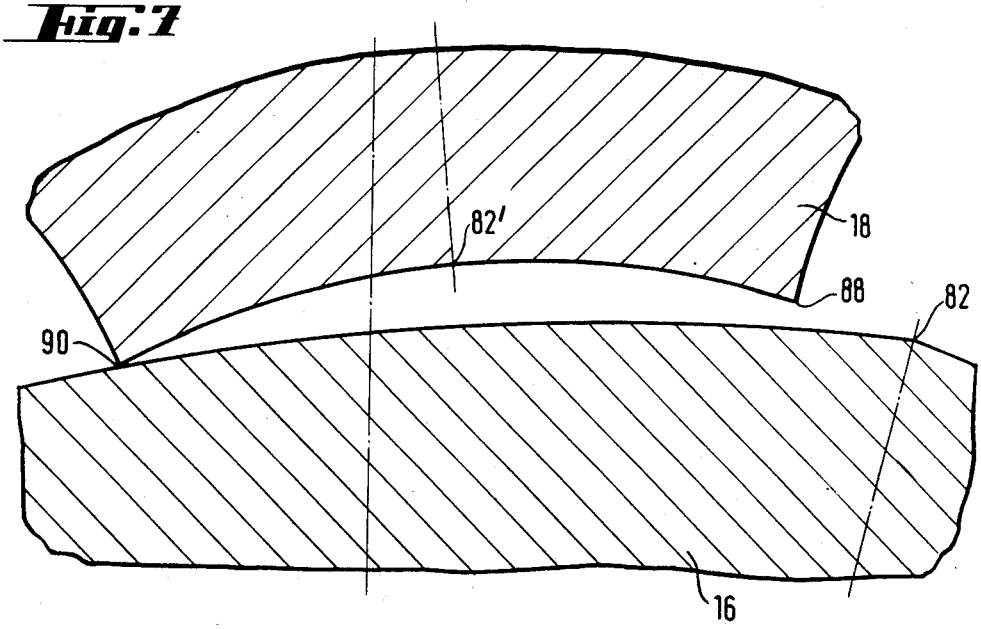

After further rotation, (FIG. 6), the head point 82 of the main rotor is in the region of the head point 88 of the auxiliary rotor, and the head point 90 still rests on the tooth flank of the main rotor. In FIG. 7, one recognizes that the head point 82 has freed itself from the auxiliary rotor, but head point 90 is still resting on the tooth flank. In turning further, the next head point 84 of the main rotor engages the auxiliary rotor and the process or the geometry, respectively, is the same as in FIGS. 4 to 7: the tooth flanks of the auxiliary rotor are defined by each respective head point of the main rotor and when a head point of a main rotor is situated between two head points of an auxiliary rotor, the head points of the auxiliary rotor rest on the tooth flank or tooth flanks, respectively, of the main rotor.

Since in the case of sharply pointed rotor teeth the tooth flanks of the auxiliary rotor are defined by the travel path of the head point of the main rotor as the main and auxiliary rotors rotate relative to each other, an explicit calculation of the tooth flanks of the auxiliary rotors is possible on a computer.

It should be noted that the blow-hole is practically null, based on the profile shape of main and auxiliary rotor. This is another special advantage of the embodiment according to the invention and the profile shape is also especially well suited for small output volumes for this reason, wherein even very small leakage can lead to a significant reduction in efficiency.

Although the present invention has been described in connection with a preferred embodiment thereof, it will be appreciated by those skilled in the art that additions, modifications, substitutions, and deletions not specifically described, may be made, without departing from the spirit and scope of the invention as defined in the appended claims.

What is claimed is:

1. A parallel and outer axial rotating pistion compressor of the type comprising at least one driven helical main rotor and one auxiliary rotor meshing therewith, said main rotor including tooth surfaces configured as a layered circular helicoid defined by the helical generation of a circle about an axis, with the plane of the circle disposed perpendicular to such axis.

2. Rotating piston compressor according to claim 1, wherein said teeth of said main rotor each include, in cross-section, a head point having the greatest distance from said axis, said auxiliary rotor includes tooth surfaces which are defined by the travel path of a point lying on the main rotor head point during the relative rolling motion of the main rotor and auxiliary rotor.

3. Rotating piston compressor according to claim 1, wherein the main rotor has at least three teeth.

* * * * *